United States Patent [19]

DeMarseilles et al.

[11] Patent Number: 4,869,083

[45] Date of Patent: Sep. 26, 1989

[54] CYLINDRICAL LEVER HANDLE LOCK

[75] Inventors: Paul H. DeMarseilles, Branford; Robert D. Glenn, Meriden; David A. Sorensen, Hamden, all of Conn.

[73] Assignee: Sargent Manufacturing Corporation, New Haven, Conn.

[21] Appl. No.: 186,385

[22] Filed: Apr. 26, 1988

[51] Int. Cl.[4] ..... E05B 9/08

[52] U.S. Cl. ..... 70/224; 70/451; 70/452; 292/337; 292/357

[58] Field of Search ..... 70/224, 489, 209, 221, 70/215–217, 381, 370, DIG. 3, 451, 452, 449, DIG. 31, DIG. 36; 292/356, 357, 337, 347, 169, DIG. 53

[56] References Cited

U.S. PATENT DOCUMENTS

| | | | |
|---|---|---|---|
| 348,656 | 9/1886 | Briggs | 292/169 |
| 604,516 | 5/1898 | Brigden | 70/449 |
| 1,042,297 | 10/1912 | Voight | 70/370 |
| 2,141,265 | 12/1938 | Dey | 292/357 |
| 2,238,066 | 4/1941 | Mantz | 292/337 |
| 2,759,754 | 8/1956 | Kaiser | 292/357 |
| 2,846,255 | 8/1958 | Wardwell, Jr. | 292/357 |
| 3,019,633 | 2/1962 | Russell et al. | 70/224 |
| 3,038,749 | 6/1962 | Check et al. | 292/357 |
| 3,048,436 | 8/1962 | Schiowitz | 292/337 |
| 3,210,976 | 10/1965 | Best | 70/224 |
| 3,955,387 | 5/1976 | Best et al. | 70/224 |
| 3,985,008 | 10/1976 | Hart | 70/224 |
| 4,428,212 | 1/1984 | Best et al. | 70/224 |
| 4,597,600 | 7/1986 | Wilke et al. | 292/347 X |
| 4,604,879 | 8/1986 | Neary et al. | 70/224 |
| 4,672,829 | 6/1987 | Gater et al. | 70/224 X |

FOREIGN PATENT DOCUMENTS

| | | | |
|---|---|---|---|
| 401571 | 9/1924 | Fed. Rep. of Germany | 70/370 |
| 1197350 | 7/1963 | Fed. Rep. of Germany | 292/357 |
| 708383 | 5/1954 | United Kingdom | 292/356 |
| 937696 | 9/1963 | United Kingdom | 292/347 |

*Primary Examiner*—Lloyd A. Gall
*Attorney, Agent, or Firm*—DeLio & Associates

[57] ABSTRACT

A cylindrical lever handle lock mounted in a door panel having a transverse bore therethrough is secured against rotation due to torque applied to the lever handles. The lock mechanism includes a lock chassis having a pair of chassis support members each having a pair of slots on their peripheries. A pair of support plates having inwardly extending tongue members slide into the support plate openings. The support plates are of a diameter greater than the bore and have openings in the periphery of each which corresponds with a hole drilled in the door panel outside of the bore. Door handle roses are secured over the support plates by through-bolts which pass through the support plate peripheral openings and the drilled door holes. Threaded bushings are also utilized to tighten the support plates on either side of the bore. Additional tabs and screws may be used to non-rotatably secure the support plates to the door panel. Separate coil spring assemblies mounted in the rose plates ensure return of the lever handles to their original position despite wear and abuse.

56 Claims, 5 Drawing Sheets

FIG. 3
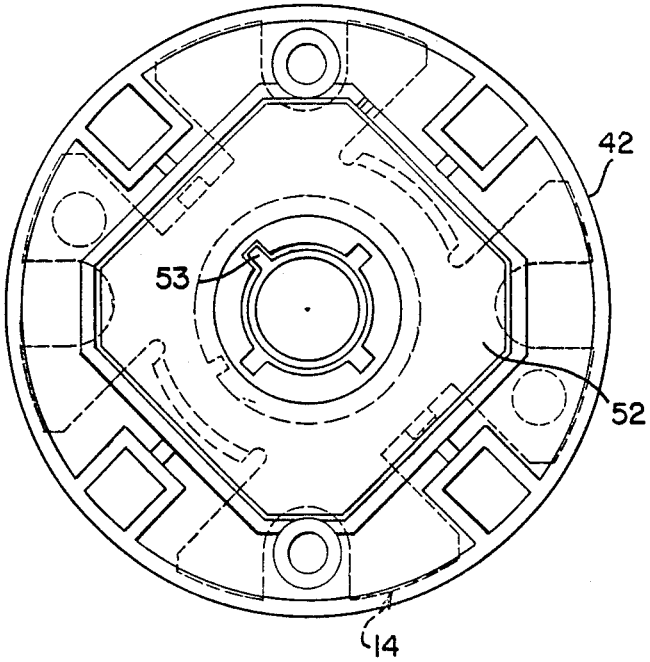
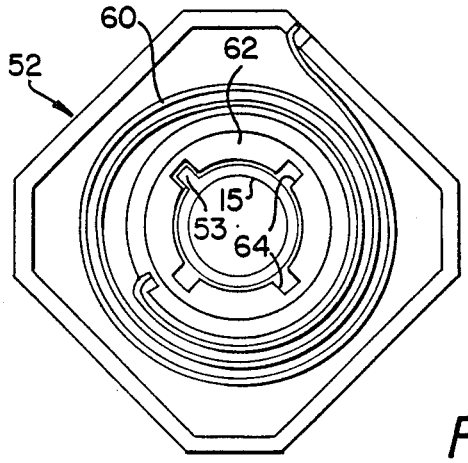
FIG. 4

FIG. 8
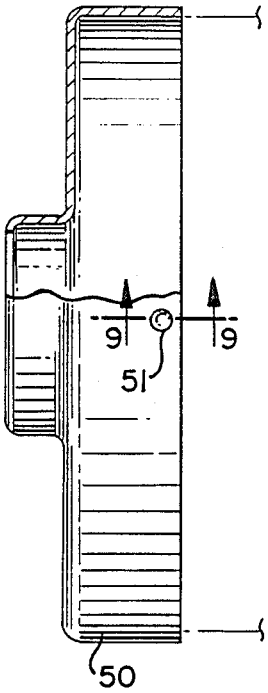
FIG. 7
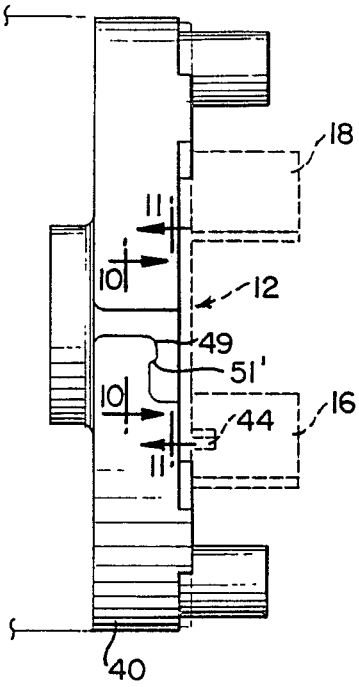
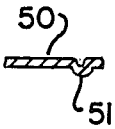
FIG. 9
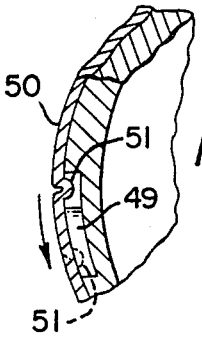
FIG. 11
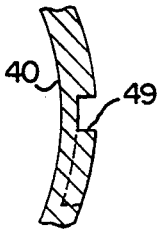
FIG. 10

CYLINDRICAL LEVER HANDLE LOCK

BACKGROUND OF THE INVENTION

This invention relates to a cylindrical lock for mounting on a door panel and, in particular, to an improved cylindrical lock assembly for use with lever-type handles.

Cylindrical locks utilized in exterior door applications must be made to withstand more severe environments and higher security usage than those utilized on interior doors. This is especially true where the cylindrical lock is utilized in conjunction with a lever type handle. Such high security exterior cylindrical lock assemblies are subject to damage by vandalism, burglary, and abuse. Damage is often magnified by the availability of the lever handle to exert considerable torque on the cylindrical lock assembly. When such cylindrical lock assemblies are overloaded, they may jam and disable the assembly, or they may even damage it to the extent that the door may be forced open. Even if such lock assembly is still functional after abuse, the lever handles themselves may be damaged and require replacement or repair.

While the prior art discloses various types of cylindrical lock assemblies, few if any are appropriate for the heavy duty security type usage required in many applications. U.S. Pat. Nos. 3,985,008 and 4,604,879 disclose different types of configurations which strengthen the attachment of the cylindrical lock to the door panel. However, neither of these configurations for securing lock chassis are considered suitable for the most severe environments.

Bearing in mind the problems with prior art cylindrical lock assemblies, it is therefore an object of the present invention to provide an improved cylindrical lever handle lock which is highly resistant to abuse, vandalism and damage in general.

It is another object of the present invention to provide a strengthened cylindrical lock assembly which is easily installed in conventional door openings.

It is a further object of the present invention to provide an improved cylindrical lock assembly which resists damage and wear to the positioning of the lever handles.

It is yet another object of the present invention to provide a strengthened cylindrical lock assembly which may be easily manufactured.

SUMMARY OF THE INVENTION

The above and other objects which will be apparent to those skilled in the art are achieved in the present invention which provides a cylindrical lock assembly for mounting in a door panel having a transverse bore therethrough. The assembly comprises a lock chassis adapted to fit within the bore and having rotatable spindles extending therefrom on either side of the door panel for actuating a latch bolt upon rotation of the spindles. The chassis also includes a support member having at least one opening therein. A support plate, having a diameter greater than the bore, is disposed on at least one side of the lock chassis for non-rotatably securing the chassis to the door and includes at least one extending tongue member which is slideable into the chassis support member opening for transmitting torque from the chassis to the support plate. The support plate also includes at least one opening near the plate periphery for insertion of a securing fastener into the door outside the bore to non-rotatably secure the support plate to the door panel.

In its preferred embodiment, the cylindrical lock includes a pair of support plates, one on each side of the lock chassis and door, each support plate having two tongue members slideable into corresponding openings in the chassis support member. The openings in the peripheries of the opposing support plates are aligned and a through bolt passing through the door outside of the lock bore also passes through these aligned openings. The through-bolt may secure opposing roses on either side of the door panel. Each support plate is secured to the lock chassis by a threaded bushing around the spindle.

The present invention, which is preferably used with lever handles, also contemplates the use of separate coil spring assemblies mounted in the rose plates to return the spindle and lever handles to their original initial position.

BRIEF DESCRIPTION OF THE DRAWINGS

FIG. 3 is a sectional view of the rose and coil spring assembly along line 3—3 of FIG. 1.

FIG. 4 is an axial cross sectional view of the coil spring assembly shown in FIG. 3.

FIG. 7 is a side view of the inside rose shown in FIG. 1.

FIG. 8 is a side view, partially in cross section, of the decorative scalp which may be installed over the rose shown in FIG. 7.

FIG. 9 is a cross sectional view along line 9—9 of the decorative scalp shown in FIG. 8.

FIG. 10 is a cross sectional view along line 10—10 of the periphery of the rose shown in FIG. 7.

FIG. 11 is a cross sectional view taken along line 11—11 of FIG. 7 showing a portion of the decorative scalp engaging with the inside rose.

DETAILED DESCRIPTION OF THE INVENTION

Figure 1:
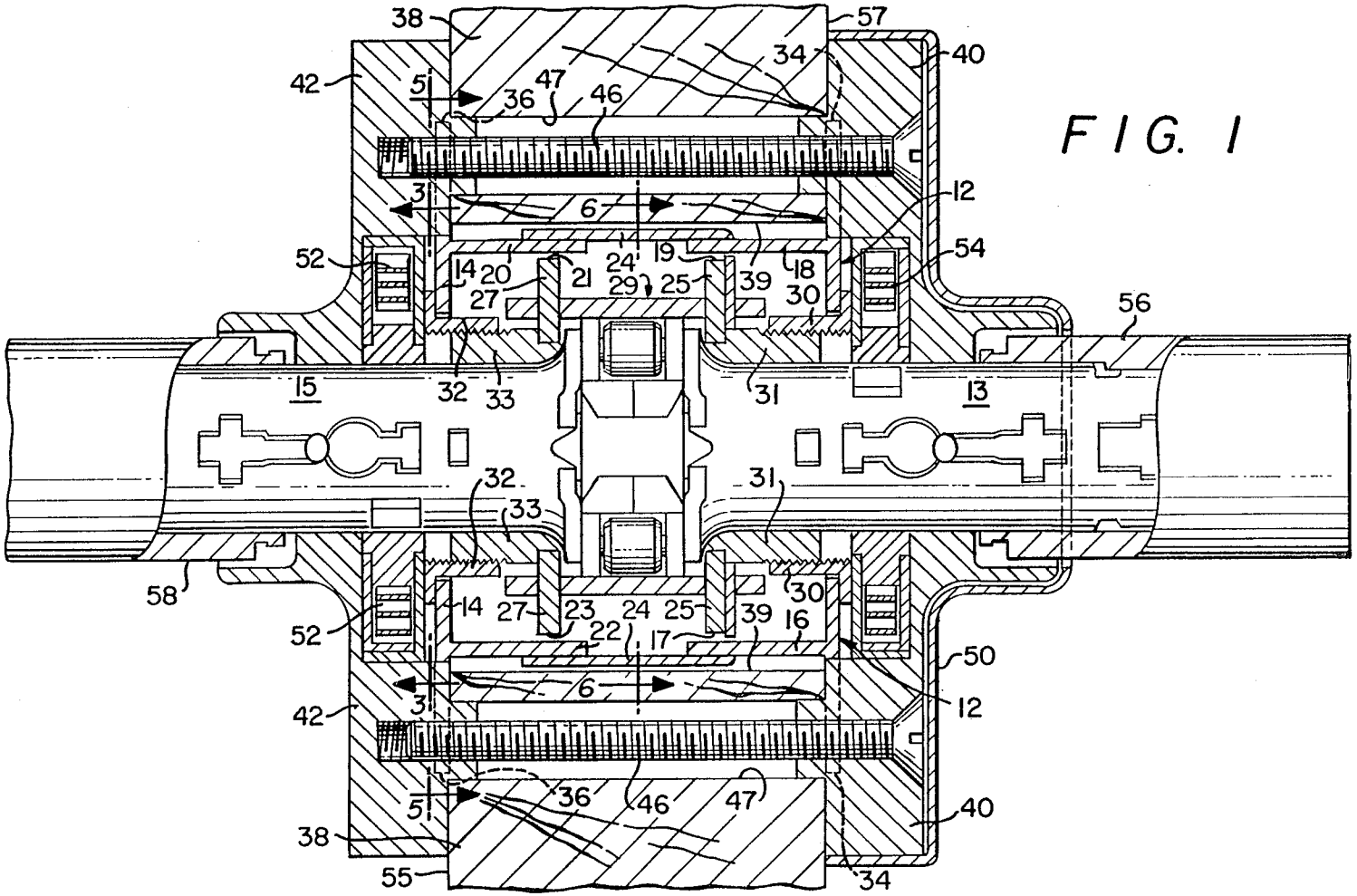
FIG. 1 is a cross sectional side view of the cylindrical lock assembly of the present invention, along the axis of the spindle and lock chassis, as it is secured in the bore of a door panel.

The preferred embodiment of the present invention is illustrated in accompanying FIGS. 1 through Like numerals are used throughout the figures to refer to like features of the invention. Except where specifically noted, the components of the present invention are preferably made of steel, brass or such other conventional materials which possess the strength and wear characteristics for use in cylindrical lock assemblies.

Figure 2:
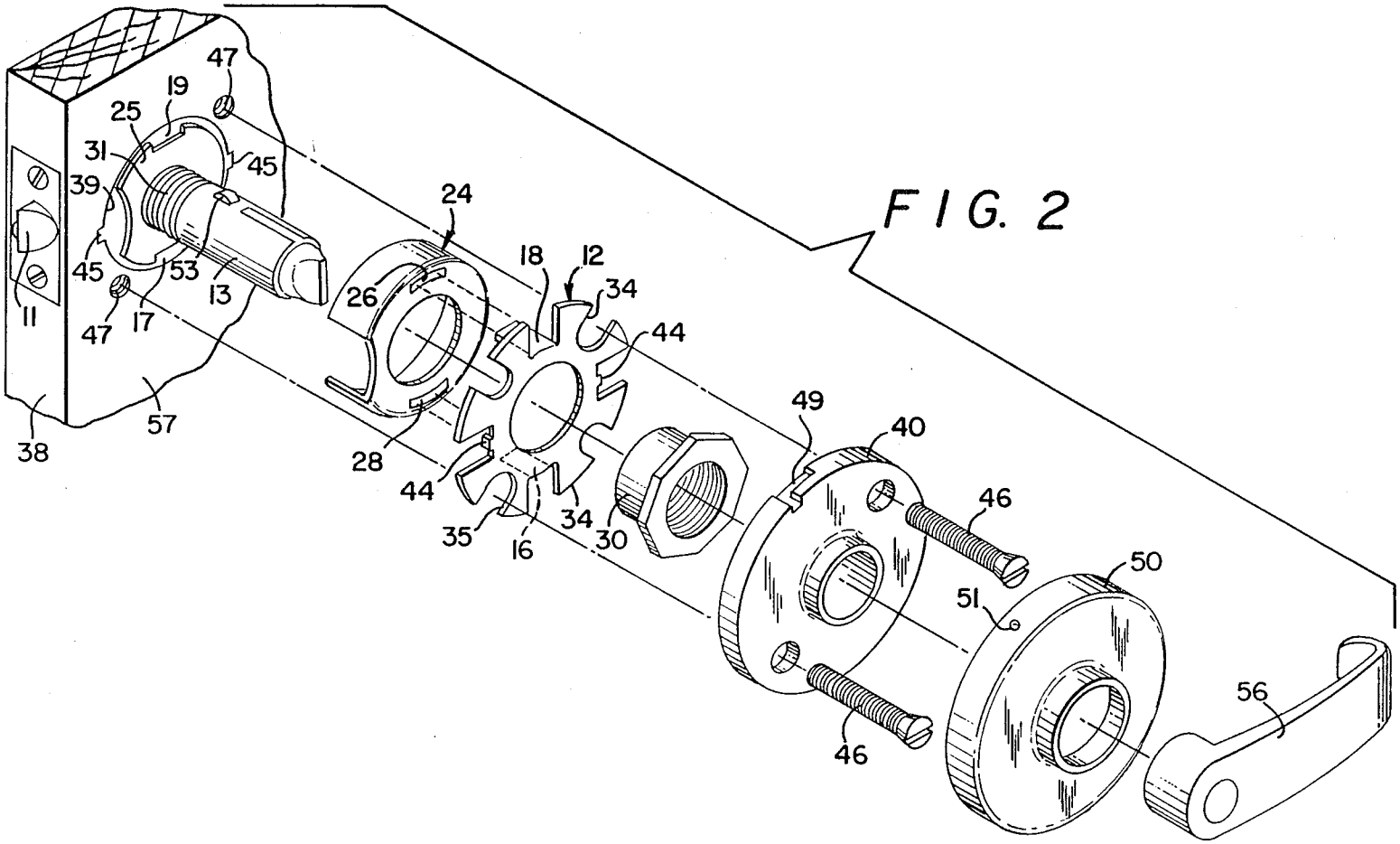
FIG. 2 is a perspective view, partially exploded, of the assembly of the interior portion of the cylindrical lock assembly of the present invention in a door panel.

Turning initially to FIGS. 1 and 2, the present invention is shown mounted in a door panel 38 which may be made of wood, steel or other conventional door material. Door panel 38 has a conventional transverse circular bore 39 therethrough between exterior door face 55 and interior door face 57. Disposed concentrically within bore 39 is a conventional lock chassis 29 which has extending axially therefrom on either side of panel 38 inside and outside spindles 13 and 15, respectively. Inside and outside lever handles 56 and 58 are respectively secured to spindles 13 and 15, and may also include conventional exterior key look and inside hand lock mechanisms for the cylindrical lock assembly. Although the present invention is considered to be most useful for lever handle applications where high amounts of torque may be applied via the handle, it is also useful for conventional knob handle applications. As shown in FIG. 2, a latch bolt assembly 11 is operable by the lock chassis 29 upon rotation of either of the spindles 13, 15 in their unlocked position.

Secured to the lock chassis and forming a part thereof, longitudinally spaced chassis plates 25 and 27 are disposed within bore 39 to serve as support members which form part of the support assembly for the cylindrical lock of the present invention. Both interior chassis plate 25 and exterior chassis plate 27 are each generally circular and planar and oriented normal to the longitudinal axis of the lock chassis. Each chassis plate contains a pair of openings to secure the chassis lock to the remainder of the cylindrical lock assembly. These openings comprise upper and lower slots 19 and 17, respectively, on interior chassis plate 25, and upper and lower slots 21 and 23, respectively, on exterior chassis plate 27. These slots are situated on the periphery of each of the chassis plates. A cylindrical housing cover 24 surrounds the major portion of lock chassis 29. Cover 24 is cup-shaped and includes slots 26 and 28 on the end wall (FIG. 2), which slots correspond to the slots in chassis plate 25.

To secure the lock chassis to the door panel 38, a pair of support plates 12 and 14 are respectively disposed on the interior face 57 and exterior face 55 of the door panel 38. Each support plate is generally circular and planar and is secured at its periphery to the opposing faces of door panel 38. Upper and lower tongue members extend longitudinally inwardly from each support plate to engage the corresponding openings in the chassis plates. The tongue members mate with the respective chassis plate slots to non-rotatably secure the support plates to the lock chassis 29. Exterior support plate 14 includes upper and lower tongue members 20 and 22, respectively, which mate with upper and lower exterior chassis plate openings 21 and 23, respectively. Interior support plate 12 includes upper and lower tongue members 18 and 16, respectively, which mate with upper and lower interior chassis plate openings 19 and 17, respectively. In the case of the interior support plate 12, the associated tongue members also pass through the corresponding slots 26, 28 in housing cover 24 (FIG. 2). As is evident from their construction, these support plates may be easily installed by sliding each plate over the associated spindle as is most clearly shown in the exploded perspective view of the inside cylindrical lock components in FIG. 2. Threaded bushings 30 and 32 are respectively installed over and around the spindles 13 and 15 and tightened on threaded hubs 31, 33 (at the base of the spindles of lock chassis 29) to secure the peripheral portions of support plates 12 and 14 onto the exterior faces 57 and 55 of the door panel. The bushings 30, 32 are screwed onto the lock chassis 29 to draw and hold the support plates snugly against the outer door panel faces 55, 57 and to prevent axial movement of the cylindrical lock assembly within the bore 39. The tight fit of the support plates 12, 14 against door panel 38 also provide some resistance to rotation of the cylindrical lock assembly 29 relative to the door panel.

To prevent the support plates 12, 14 from rotating relative to the door panel bore 39, there are provided openings near the periphery of each support plate which are secured to door panel 38 by through-bolts 46. As shown most clearly in FIG. 5 in connection with exterior support plate 14, four openings or slots 37 are equally spaced around the periphery 36 of the support plate. Comparable openings 35 are provided at the periphery 34 of interior support plate 12 (FIG. 2). One or more of these support plate openings corresponds with bolt holes 47 drilled through door panel 38 outside of the opening of bore 39. As shown in FIG. 1, escutcheons or roses 40 and 42 are mounted over and outside of support plates 12 and 14 respectively. Threaded bolts 46 pass sequentially through holes in interior rose 40, support plate 12 openings 35, door panel holes 47, outer support plate 14 openings 37, and are screwed into corresponding threaded holes in exterior rose 42. In this fashion, support plates 12 and 14 are non-rotatably secured by the pair of bolts 36 relative to bore 39. Roses 40 and 42 contain recesses on their inner faces corresponding to the support plates so that the peripheries of the roses may be butted against the door panel exterior faces.

Figure 5:
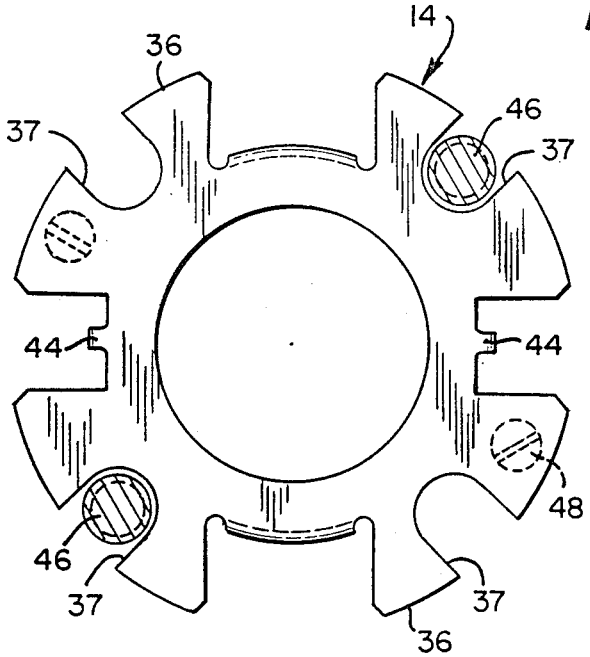
FIG. 5 is an end view of the support plate utilized in the present invention as seen along line 5—5 of FIG. 1.
Figure 5A:
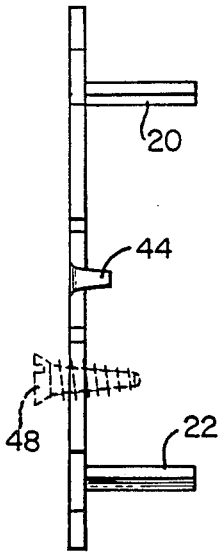
FIG. 5*a* is a side view of the support plate shown in FIG. 5.

To provide additional resistance to rotation, door panel bore 39 may be provided with slots 45 which receive corresponding tabs 44 pressed or formed on interior support plate 12, as shown in FIG. 2. Comparable tabs and slots may be utilized in the exterior support plate 14 against the exterior bore opening 39. Also, as shown in FIGS. 5 and **5*a* in connection with exterior support plate 14, additional holes may be provided in the periphery of each support plate to permit screws 48 to secure the support plates to the door panel 38**.

Figure 6:
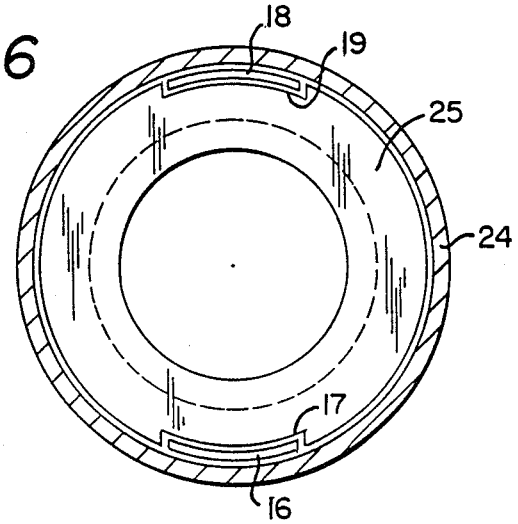
FIG. 6 is a cross sectional view, taken along lines 6—6 of FIG. 1, showing the support plate tongue members engaged in the chassis plate peripheral slots and passing through the cylindrical housing cover.

In FIG. 6 there is shown the relationship of the tongue members 18 and 16 of support plate 12 as they are respectively mated with slots 19 and 17 of interior chassis plate 25. The tongue members 16, 18 pass through openings in the end of cylindrical housing cover 24 which surrounds and protects the lock chassis 29. Cover 24 also helps to prevent movement of the tongue members out of their respective chassis plate slots.

A decorative scalp 50 made of plated sheet metal is secured over and covers rose 40 to hide and protect the bolt 46 heads in the interior rose 40. A dimple (51) and slot (49) arrangement on the scalp and rose serves to secure the scalp. As shown more clearly in FIGS. 8 through 11, an L-shaped slot 49 on rose 40 has one leg oriented along its periphery in an axial direction and the second leg oriented perpendicular to the first leg. An inwardly pressed dimple 51 on the outer periphery of the scalp 50 slides longitudinally straight into the first leg of slot 49 whereupon the scalp 50 may be twisted to seat dimple 51 in the second leg of slot 49. A slight projection 51, in the wall of slot 49 at the convergence of the two legs serves to hold the scalp dimple 51 in the secured position. When interior handle 56 is secured over inner spindle 13, scalp 50 may not be removed and serves to resist removal of the through-bolt 46 and the cylinder lock mechanism from the inside of the door.

As shown in FIG. 2, interior handle 56 is secured by conventional key and slot arrangement onto interior spindle 13. Likewise, a comparable exterior handle 58 is secured over exterior spindle 15 (see FIG. 1). Both spindles 13 and 15 are returned to their original positions after rotation by a spring mechanism within lock chassis 29.

To provide additional spring return of spindles 13, and their associated handles, and to resist the effects of wear, abuse, vandalism, etc. additional spindle and handle return spring assemblies are provided within each of the roses 40 and 42. As shown in FIGS. 1, 3 and 4, roses 40 and 42 each include separate, mirror-image coil spring assemblies 54 and 52, respectively. As seen in FIGS. 3 and 4, spring assembly 52 has a generally square exterior shape which is non-rotatably compression fitted into a comparable, essentially square opening within rose 42. A coil spring 60 within assembly 52 has a first end attached to the exterior of the spring case and a second end attached to an interior rotor 62 which contains slots or key ways 64 spaced at 90° intervals. A corresponding tab or key 53 on the periphery of exterior spindle 15 fits within one of the key ways 64. Upon rotation of exterior handle 58, spindle 15 winds the coil spring 60 which, upon release of handle 58, then forces the spindle 15 back into its original position. Spring assembly 54 within rose 40 is generally the mirror image of spring assembly 52 and serves to return interior handle 56 and interior spindle 13 to their original position after rotation. Thus, the handles of the cylindrical lock assembly of the present invention are able to resist sagging after abusive wear, tear and vandalism.

Thus, the present invention provides a strong, easily manufactured, easily assembled cylindrical lock which is able to resist damage due to wear, abuse and vandalism. During assembly, the lock chassis may be mounted in the door panel bore in the usual manner and thereafter the support plates 12 and 14 may be inserted and secured in place by tightening their respective threaded bushings 30 and 32 in place. Holes 47 drilled in the door panel 38 outside of the transverse bore 39 receive threaded bolts 46 which secure the respective roses 40 and 42 on opposite faces of the door panel. Bolts 46 also pass through openings in the peripheries of support plates 12 and 14 to secure the lock chassis in the door panel in a non-rotatable manner. Where additional security is required, the support plates 12 and 14 may include tabs which fit into corresponding slots in the door panel bore and/or may also be directly secured to the door panel by screws. Accordingly, high amounts of torque applied to the lever handles 56 and 58 are successfully resisted by transmitting this torque directly to the door panel and prevent such high torque from damaging the operation of the lock chassis 29 and latch mechanism 11. The use of additional separate spring assemblies in each of the roses ensures that the door handles 56, 58 and spindles 13, 15 continue to return to their original positions despite wear, tear and general abuse.

While this invention has been described with reference to a specific embodiment, it will be recognized by those skilled in the art that variations are possible without departing from the spirit and scope of the invention, and that it is intended to cover all changes and modifications of the invention disclosed herein for the purposes of illustration which do not constitute departure from the spirit and scope of the invention.

Having thus described the invention, what is claimed is:

1. A cylindrical lock for mounting in a door panel having a transverse bore therethrough comprising:

a lock chassis, adapted to fit within said bore, having rotatable spindles extending therefrom for actuating a latch bolt upon rotation of said spindles, said chassis including a support member having at least one opening therein;

a pair of support plates, each having a diameter greater than said bore, on opposite sides of said lock chassis for non-rotatably securing said chassis to said door, at least one of said support plates having thereon at least one extending tongue member slideable into said chassis support member opening for transmitting torque from said chassis to said support plate, each of said support plates including at least one opening near its periphery for insertion of a securing fastener into said door outside said bore to non-rotatably secure said support plate to said door panel; and a threaded bushing, around each of said spindles, for bearing against each of said support plates to secure said support plates to said lock chassis whereby tightening of said bushings draws said support plates towards each other and snugly against the door panel.

2. The lock of claim 1 wherein each support plate has at least one tongue member slideable into a corresponding opening in said chassis support member.

3. The lock of claim 2 wherein the opening in the periphery of each of the opposing support plates is aligned with the other support plate opening and said fastener comprises a bolt for insertion through said door and between the aligned support plate openings.

4. The lock of claim 1 wherein each of said support plates includes screw holes near the periphery for securing said support plate to said door using screws.

5. The lock of claim 1 further comprising a cover for said lock chassis, said cover having openings therein for insertion of said support plate tongue members.

6. The lock of claim 1 wherein each support plate includes a pair of tongue members slideable into corresponding openings in said chassis support member on opposite sides of at least one of said spindles.

7. The lock of claim 6 wherein the opening in each of the opposing support plates is aligned with the other support plate opening and said fastener comprises a bolt for insertion through said door and between the aligned support plate openings.

8. The lock of claim 1 wherein said lock further includes a rose through which a spindle extends for mounting on said door panel on the exterior side of said support plate, said rose being securable by said fastener to said door.

9. The lock of claim 8 wherein said lock further includes a pair of roses through which said spindles extend for mounting on opposite sides of said door panel on the exterior side of each of said support plates and wherein said fastener extends between and secures said pair of roses.

10. The lock of claim 8 further comprising a decorative scalp for covering said rose an said fastener.

11. The lock of claim 10 wherein said scalp is securable over said rose by a dimple and slot arrangement to permit said scalp to be pushed onto said rose and turned to be secured in place.

12. The lock of claim 8 further comprising a spring assembly mounted in said rose for returning the spindle extending from the rose to an initial position after rotation thereof.

13. The lock of claim 12 wherein said spring assembly comprises a coil spring surrounding the spindle extending from the rose.

14. The lock of claim 12 wherein the spindle extending from the rose is secured to one end of said spring assembly.

15. The lock of claim 14 wherein the spindle extending from the rose engages said spring assembly by a tab and slot arrangement.

16. The lock of claim 1 further including a lever handle for rotating one of said spindles.

17. The lock of claim 1 wherein each support member comprises a plate and said support member opening comprises a slot in the periphery of said plate.

18. The lock of claim 1 wherein each support plate includes screw holes near the periphery for securing said support plate to said door using screws.

19. The lock of claim 1 further comprising a cover for said lock chassis, said cover having openings therein for insertion of said support plate tongue member.

20. A cylindrical lock for mounting in a door panel having a transverse bore therethrough comprising:

a lock chassis, adapted to fit within said bore, having rotatable spindles extending therefrom for actuating a latch bolt upon rotation of said spindles, said chassis including a support member having at least one opening therein;

a support plate, having a diameter greater than said bore, on at least one side of said lock chassis for non-rotatably securing said chassis to said door, said support plate having thereon at least one extending tongue member slideable into said chassis support member opening for transmitting torque from said chassis to said support plate, said support plate including at least one opening near its periphery for insertion of a securing fastener into said door outside said bore to non-rotatably secure said support plate to said door panel;

a rose through which a spindle extends for mounting on said door panel on the exterior side of said support plate, said rose being securable by said fastener to said door; and a decorative scalp for covering said rose and said fastener.

21. The lock of claim 20 including a pair of support plates, each support plate being located on opposite sides of said lock chassis and having at least one tongue member slideable into a corresponding opening in said chassis support member, and wherein the opening in the periphery of each of the opposing support plates is aligned with the other support plate opening and said fastener comprises a bolt for insertion through said door and between the aligned support plate openings.

22. The lock of claim 20 further comprising a threaded bushing around one of said spindles for securing said support plate to said lock chassis.

23. The lock of claim 20 further including a lever handle for rotating one of said spindles.

24. The lock of claim 20 wherein said support member comprises a plate and said support member opening comprises a slot in the periphery of said plate.

25. The lock of claim 20 further comprising a spring assembly mounted in said rose for returning said spindle to an initial position after rotation thereof.

26. The lock of claim 20 wherein said scalp is securable over said rose by a dimple and slot arrangement to permit said scalp to be pushed onto said rose and turned to be secured in place.

27. A cylindrical lock for mounting in a door panel having a transverse bore therethrough comprising:

a lock chassis, adapted to fit within said bore, having rotatable spindles extending therefrom for actuating a latch bolt upon rotation of said spindles, said chassis including a support member having a pair of openings therein on opposite sides of at least one of said spindles;

a pair of support plates, each having a diameter greater than said bore, on opposite sides of said lock chassis for non-rotatably securing said chassis to said door, each of said support plate having thereon a pair of extending tongue members slideable into said chassis support member openings for transmitting torque from said chassis to said support plate, each of said support plates including at least one opening near its periphery for insertion of a securing fastener into said door outside said bore to non-rotatably secure said support plate to said door panel; and a pair of roses through which said spindles extend for mounting on opposite sides of said door panel on the exterior side of each of said support plates and wherein said fastener extends between and secures said pair of roses.

28. The lock of claim 27 wherein the opening in the periphery of each of the opposing support plates is aligned with the other support plate opening and said fastener comprises a bolt for insertion through said door and between the aligned support plate openings.

29. The lock of claim 27 further comprising a threaded bushing around one of said spindles for securing one of said support plates to said lock chassis.

30. The lock of claim 27 further including a lever handle for rotating at least one of said spindles.

31. The lock of claim 27 wherein said support member comprises a plate and said support member opening comprises a slot in the periphery of said plate.

32. The lock of claim 27 further comprising a decorative scalp for covering one of said roses and said fastener.

33. The lock of claim 32 wherein said scalp is securable over said rose by a dimple and slot arrangement to permit said scalp to be pushed onto said rose and turned to be secured in place.

34. The lock of claim 27 further comprising a spring assembly mounted in at least one of said roses for returning the spindle extending from the rose to an initial position after rotation thereof.

35. The lock of claim 34 wherein the spindle extending from the rose is secured to one end of said spring assembly.

36. The lock of claim 35 wherein the spindle extending from the rose engages said spring assembly by a tab and slot arrangement.

37. The lock of claim 34 wherein said spring assembly comprises a coil spring surrounding the spindle extending from the rose.

38. A cylindrical lock for mounting in a door panel having a transverse bore therethrough comprising:

a lock chassis, adapted to fit within said bore, having rotatable spindles extending therefrom for actuating a latch bolt upon rotation of said spindles, said chassis including a support member having at least one opening therein;

a support plate, having a diameter greater than said bore, on at least one side of said lock chassis for non-rotatably securing said chassis to said door, said support plate having thereon at least one extending tongue member slideable into said chassis support member opening for transmitting torque from said chassis to said support plate, said support plate including at least one opening near its periphery for insertion of a securing fastener into said door outside said bore to non-rotatably secure said support plate to said door panel;

a rose through which a spindle extends for mounting on said door panel on the exterior side of said support plate, said rose being securable by said fastener to said door; and a spring assembly mounted in said rose for returning the spindle extending from the rose to an initial position after rotation thereof.

39. The lock of claim 38 wherein said support plate includes a pair of tongue members slideable into corresponding openings in said chassis support member on opposite sides of at least one of said spindles.

40. The lock of claim 39 including a pair of said support plates, each support plate being located on opposite sides of said door panel and lock chassis.

41. The lock of claim 40 further comprising a threaded bushing around each of said spindles for securing said support plates to said lock chassis.

42. The lock of claim 41 wherein said support plates include screw holes near the periphery for securing said support plates to said door using screws.

43. The lock of claim 38 further including a lever handle for rotating at least one of said spindles.

44. The lock of claim 38 further comprising a decorative scalp for covering said rose and said fastener, and wherein said scalp is securable over said rose by a dimple and slot arrangement to permit said scalp to be pushed onto said rose and turned to be secured in place.

45. The lock of claim 38 wherein the spindle extending from the rose is secured to one end of said spring assembly.

46. The lock of claim 45 wherein the spindle extending from the rose engages said spring assembly by a tab and slot arrangement.

47. The lock of claim 38 wherein said spring assembly comprises a coil spring surrounding the spindle extending from the rose.

48. A cylindrical lock for mounting in a door panel having a transverse bore therethrough comprising:

a lock chassis, adapted to fit within said bore, having rotatable spindles extending therefrom for actuating a latch bolt upon rotation of said spindles, said chassis including a support member having at least one opening therein;

a support plate, having a diameter greater than said bore, on at least one side of said lock chassis for non-rotatably securing said chassis to said door, said support plate having thereon at least one extending tongue member slideable into said chassis support member opening for transmitting torque from said chassis to said support plate, said support plate including at least one opening near its periphery for insertion of a securing fastener into said door outside said bore to non-rotatably secure said support plate to said door panel; and a cover for said lock chassis, said cover having opening therein for insertion of said support plate tongue member.

49. The lock of claim 48 wherein said lock further includes a rose through which a spindle extends for mounting on said door panel on the exterior side of said support plate, said rose being securable by said fastener to said door.

50. The lock of claim 49 wherein said support member comprises a plate and said support member opening comprises a slot in the periphery of said plate.

51. The lock of claim 49 further comprising a threaded bushing around one of said spindles for securing said support plate to said lock chassis.

52. The lock of claim 51 further including lever handles for rotating said spindles.

53. The lock of claim 51 further comprising a spring assembly mounted in said rose for returning the spindle extending from the rose to an initial position after rotation thereof.

54. The lock of claim 53 wherein said support plate includes screw holes near the periphery for securing said support plate to said door using screws.

55. The lock of claim 51 further comprising a decorative scalp for covering said rose and said fastener.

56. The lock of claim 55 wherein said scalp is securable over said rose by a dimple and slot arrangement to permit said scalp to be pushed onto said rose and turned to be secured in place.

* * * * *

UNITED STATES PATENT AND TRADEMARK OFFICE

CERTIFICATE OF CORRECTION

PATENT NO. : 4,869,083

DATED : September 26, 1989

INVENTOR(S) : Paul H. DeMarseilles et al

It is certified that error appears in the above-identified patent and that said Letters Patent is hereby corrected as shown below:

In column 2, line 58 after "through" insert --11.--.

In column 6, line 60 delete "an" and substitute therefor --and--.

Signed and Sealed this

Twenty-fifth Day of September, 1990

*Attest:*

HARRY F. MANBECK, JR.

*Attesting Officer*

*Commissioner of Patents and Trademarks*